United States Patent [19]

Marter

[11] Patent Number: 4,896,916

[45] Date of Patent: Jan. 30, 1990

[54] CHAIR FOR CUTTING CHILDREN'S HAIR

[75] Inventor: Michael Marter, Bismarck, N. Dak.

[73] Assignee: Kaemark, Inc., Giddings, Tex.

[21] Appl. No.: 380,693

[22] Filed: Jul. 13, 1989

Related U.S. Application Data

[63] Continuation of Ser. No. 229,747, Aug. 3, 1988, abandoned, which is a continuation of Ser. No. 944,571, Dec. 22, 1986, abandoned.

[51] Int. Cl.[4] ..... A63G 9/10

[52] U.S. Cl. ..... 297/181; 297/195; 297/423; 297/347

[58] Field of Search ..... 297/423, 181, 195, 347

[56] References Cited

U.S. PATENT DOCUMENTS

| | | | |
|---|---|---|---|
| 275,384 | 4/1883 | Howe | 297/423 X |
| 1,334,038 | 3/1920 | Koken | 297/181 |
| 1,473,541 | 11/1923 | Berninghaus | 297/181 |
| 1,620,448 | 3/1927 | Dourdoufis | 297/195 |
| 2,516,801 | 7/1950 | Renaud | 297/423 X |
| 2,529,780 | 11/1950 | Miller | 297/423 X |
| 2,713,889 | 7/1955 | White | 297/423 X |
| 3,143,332 | 8/1964 | Watlington | 297/347 X |
| 3,179,369 | 4/1965 | Hale | 297/347 X |
| 4,516,766 | 5/1985 | Sutton | 297/181 |
| 4,624,341 | 11/1986 | Lee | 182/15 |

*Primary Examiner*—Francis K. Zugel

*Attorney, Agent, or Firm*—Zarley, McKee, Thomte, Voorhees & Sease

[57] ABSTRACT

The invention comprises a chair for cutting children's hair. The chair has a base portion and a hydraulic cylinder and piston with the cylinder mounted to the base to hydraulically raise and lower the piston. A platform having a series of steps of different heights is mounted to the top of the piston and an animated object is mounted on the platform. The platform has steps on each side of the object. The platform has a central saddle portion for a child to sit astride with its legs straddling on each side of the object. The platform is a convenient distance below the object so that a child may rest its feet on each side of the object on a selected step of the platform, depending upon the size of the child, to brace and balance the child and to provide stability to the child on the object so that the child may with less effort remain upright in the saddle straddling the object without a head and back rest and it makes it easier for the child to remain relatively still with less movement either to the side or front or rear thereby making it easier to cut the child's hair and the lack of a head or back rest or side support makes the child's hair more accessable for cutting.

3 Claims, 2 Drawing Sheets

FIG.3
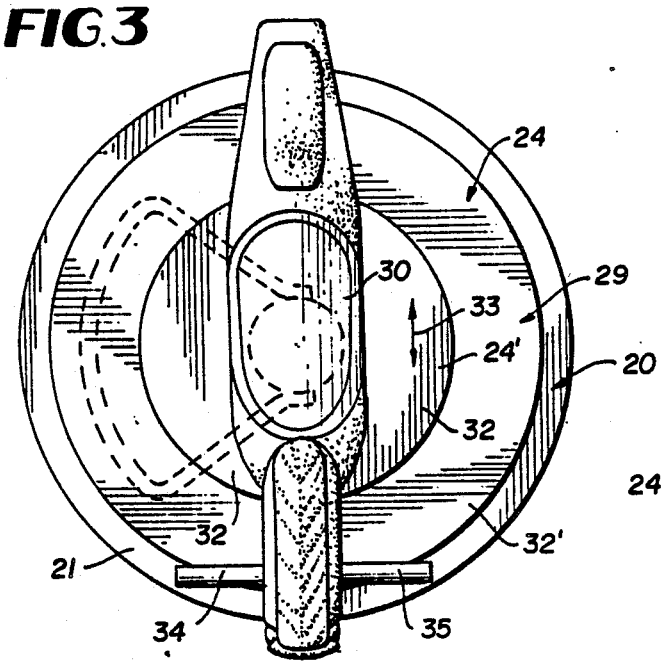
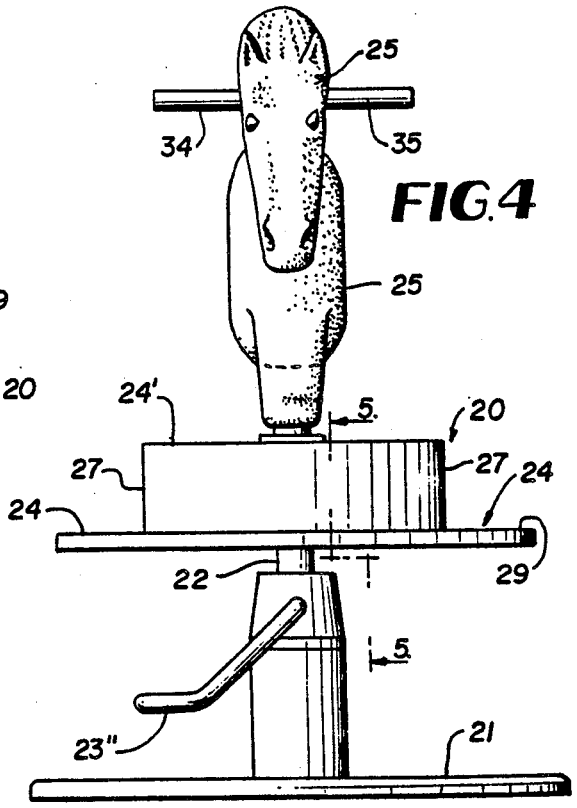
FIG.4
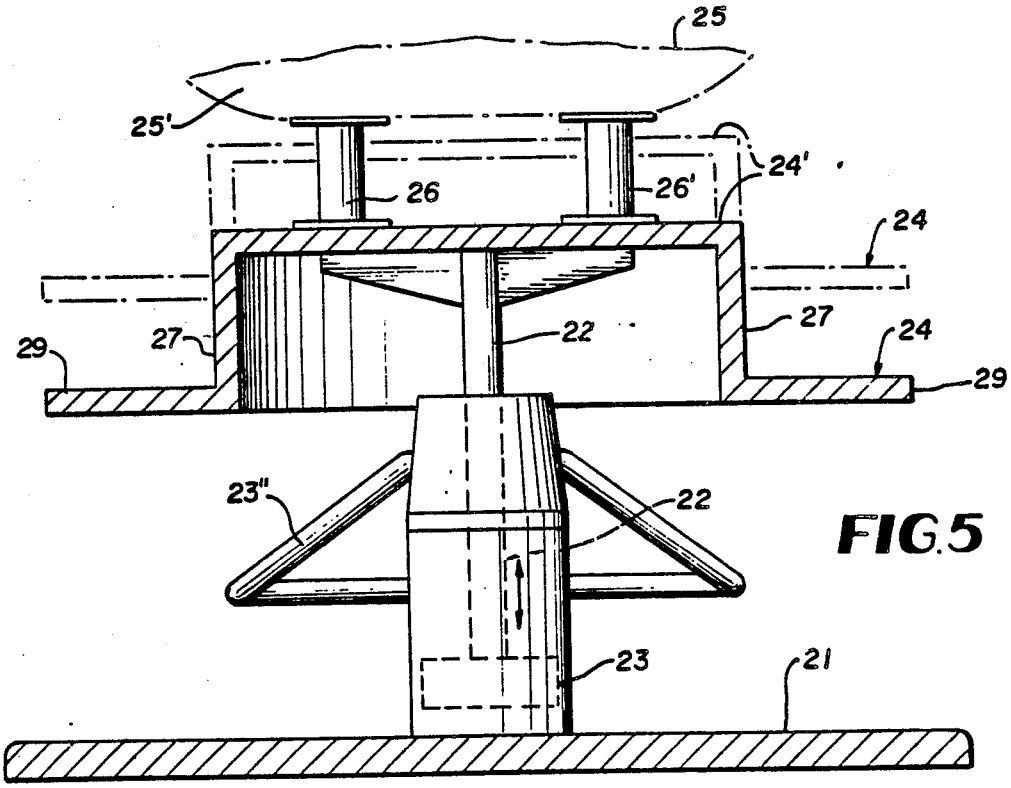
FIG.5

CHAIR FOR CUTTING CHILDREN'S HAIR

This is a continuation of copending application Ser. No. 229,747, filed Aug. 3, 1988, which is a continuation of application Ser. No. 994,571, filed Dec. 22, 1986, now abandoned.

This invention relates to chairs for cutting children's hair.

It is an object of the invention to provide a novel chair having an object for a child to sit straddled upon with its legs on each side of the object and with a step like foot rest for the child's feet to conveniently rest upon on each side of the object while straddled in an upright position and which object and foot rest is sufficiently comfortable for the child while in an upright position that the child tends to move about less and remain in an upright position with more stability for a longer period of time so that the child's hair can be more easily cut.

It is another object of the invention to provides a novel chair for cutting children's hair that is comfortable for the child and is enought of an attraction to the child that the may tend to wish to remain on the object and which provides a resting support for its body and feet while in an uprigh position so that it can stay in an upright position with less movement for longer periods of time for more convenient cutting of the child's hair.

It is a further object of the invention to provide a novel chair support for a child while cutting a child's hair that can comfortably support it in an upright position without a back and head rest so that they will tend to remain upright for longer periods of time with less movement about for easier cutting of the child's hair.

It is a further object of the invention to provide a children's chair for cutting hair having a base having a mounting portion adjustable upward and downward and which has a platform with several steps that it mounted to said adjustable portion and an animate object mounted to the top of the platform and with the object and platform being adjustable by the mounting mortion, the animated object providing a supporting surface for the child to sit upon and straddle and the platform providing steps so that the child can conveniently rest its feet which tends to cause the child can conveniently rest its feet which tends to cause the child to improve its balance while seated upright on the object and more comfortable so that the child may more easily sit for longer periods of time with less movement and thereby making it easier for cutting the child's hair.

It is a further object of the invention to provide a novel children's chair for cutting hair that is adjustable to different heights and is sufficiently comfortable to a child to sit upright thereon that the child will have less tendency to move about to remain comfortable while upright thereby making it easier to cut the child's hair.

Further objects and advantages of the invention will become apparaent as the description proceeds and when taken in conjunction with the accompanying drawings wherein:

FIG. 3 is a top plan view of the chair for cutting a child's hair.

FIG. 4 is a front elevational view of the chair for cutting a child's hair.

FIG. 5 is a fragmentary view of the top hat platform foot rest for the chair interconnecting the adjustable base with the animated object for the child to sit upon.

Briefly stated, the invention comprises a child's chair for cutting a child's hair having an adjustable base with a platform foot rest with steps of different heights mounted to the adjustable base and with an animated object mounted to the top of the platform foot rest and with the foot rest and object be adjustable in relation to the base, said animated object having a saddle like portion for a child to straddle and sit upright uon without a back rest, the steps of the foot rest platform being a convenient distance below the saddle on each side of the object for the child to rest its feet upon while seated upright to assist the child in remaining upright and with the foot rest's several steps enabling the child to selectively position its feet depending upon the size of the child for providing comfort and stability to the child while in an upright position and better balance against side to side or front and rear movement so that the child will have less tendency to move about for easier cutting of the child's hair.

Figure 1:
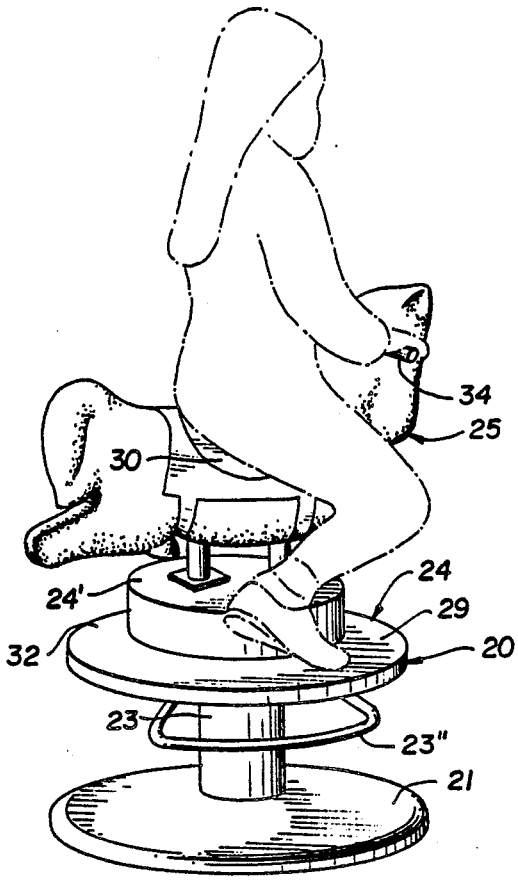
FIG. 1 is a perspective view of the child's hair cutting chair with a child shown seated in a straddled position on an animated portion of the chair and with its feet resting upon the steps of a foot rest support platform for the chair.
Figure 2:
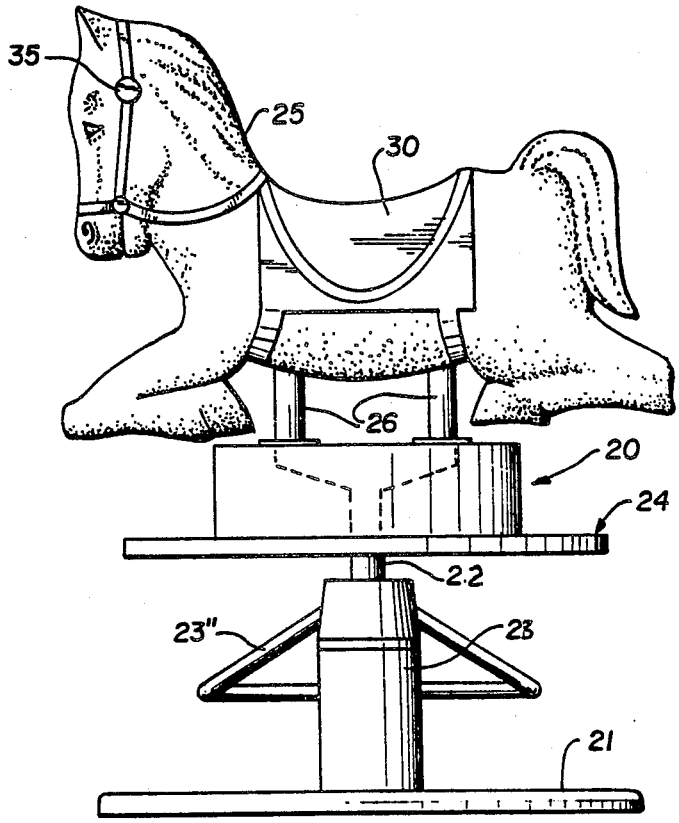
FIG. 2 is a side elevational view of the child's hair cutting chair.

Referring more particularly to the drawings, in FIG. 1 the child's hair cutting chair is illustrated having a disc like base 21 with a conventional hydraulic cylinder 22 mounted thereon to hydraulically raise and lower a piston 23 in the cylinder. A step like platform 24 is mounted to the top of the piston 23 and an animated object 25 is mounted to the top 24' of the platform 24.

The platform 24 has a pair of posts 26 and 26' mounted to the disc like top 24' of the platform foot rest which fixedly connect at their upper ends to the bottom 25' of the animated object 25. A circular vertical wall 27 surrounds the top 24' and is fixed at its top to the disc 24'. The top 24' serves as a top step for a child's feet to rest upon and the flat rim 29 fixed to the lower edge of the vertical wall 27 provides a lower step for the child's feet to rest upon. The platform 24 has the simulated appearance of a top hat.

while the chair invention 20 is illustrated with a horse as the animated object 25, a variety of other animated objects such as a duck, seal, elephant and etc. may be used in lieu thereof as the animated object, all of which will be provided with a saddle like center portion 30 for the child to sit astride with its legs straddling the object 25 on each side. The animated object is preferrabley a common variety animal, wild or domestic, that a child may recognize and associate with and be more comfortable with.

The platform foot rest 24 is a convenient distance below the saddle 30 of the animated object 25 and provides a foot rest for the child whereby children of various sizes may selectively position and rest their feet upon each side of either the top step 24' or the lower step 29, depending upon the size of the child. The foot rest of the steps provides a convenient surface for resting their feet while seated upright and for bracing and stabilizing and balancing them while seated upright so that the child will be more comfortable and it will be easier for the child to sit in this upright position and thereby less likely to move about and less need and since the chair has no back rest it provide a more convenient accessable position for cutting the child's hair with the less likelihood of movement facilitating the cuttingof the hair.

It has been found that a smaller child, for example, will be more comfortable with is feet resting upon the top surface or top step 24' of the platform while straddling the object and seated in the saddle 30; while a larger child, having longer legs, will tend to be more comfortable by comparision with its feet resting upon the lower step 29. It has further been found that by their being able to place their feet spread apart on the platform step or steps on opposite sides of the object, resting upon opposite side surface portions 32 and 32 ', it places the child in a more stable, balanced position and braces them against side to side movement on their part with less likelihood of side to side movement so that they tend to move their head less for easier cutting of the child's hair.

It has been further found that by providing a flat broad surface for the steps in a front rear direction as indicated by arrows 33. These broad surfaces for the child's feet to rest upon being in a front rear direction enable the child to balance and brace better against front-rear movement a rung, for example ; so that the child can better maintain its balance in a front-rear direction. There is thereby less need for the child to move in a front-rear direction to correct its balance and they thereby tend to remain still for longer periods of time in a front-rear direction for easier cutting of the child's hair. Since the platform is relatively large and circular, the steps are relatively broad, having significant distance in a front rear direction.

Also, with this chair construction; the child sits upright without a back rest, head rest, or side support, so the child is more accessable from either side or the back for cutting the child's hair, making it easier to perform the hair cutting operation.

While the object 25 of the chair device, which the child sits upon is illustrated as an animate object, namely a horse; it is found that the device also functions to attract the child to the chair and it will likely want to remain in the chair in many instances when an inanimate object such as a simulated bike is used for the object 25. Thus it is found that by making the object something the child is familiar with, whether animate or inanimate such as a bike and comfortable with, the child will be more likely be attracted to and want to sit in and remain in the chair thereby making it easier to get the child into the chair for the hair cut, as well as easier to remain in the chair during the hair cut.

also, a handle bar with end grip portions 34 and 35 may be provided for the animate or inanimate object for the child to grip with its hands on each side of the object while seated on the object 25. This further assists the child in balancing on the object so as to remain thereon eaaier with less need to move about for easier cutting of the child's hair. Also, it an inanimate object such as a bike is used, a simulated seat may be provided in leiu of a saddle.

By providing a hydraulic means to raise and lower the steps and object, which serve as the chair, in relation to the base, the chair is thereby adjustable to place the child at a height convenient to the person cutting the child's hair. A conventional lever 23" is pivotally mounted to the cylinder for pumping fluid to raise and lower the piston for raising and lovering the chair.

The top 24" of the platform and the top of the rim 29 can be provided with anti-skid surfaces.

thus, it will be seen that a novel children's hair cutting chair has been provided which causes the child to remain still for longer periods of time while seated upright without a back or side rest which facilitates cutting the child's hair and which enables the side and back of the child's hair to be readily accessable for cutting of the hair, and which construction serves children of different ages and sizes and which is adjustable to different levels.

It will be obvious that various changes and departures may be made to the invention without departing from the spirit and scope thereof, and accordingly, it is not intended that the invention be limited to that specifically described in the specification or as illustrated in the drawings but only as set forth in the appended claims wherein:

What is claimed is:

1. A children's barber chair comprising:

a base adapted to rest on a supporting surface;

a hydraulic cylinder attached to said base and extending upwardly therefrom;

a piston mounted within said cylinder for reciprocating movement in a vertical direction within said cylinder, said piston having a rod connected thereto and extending vertically upwardly to terminate in an upper rod end;

platform means connected to said upper rod end of said piston rod for movement in unison therewith, said platform means comprising a first flat circular horizontal surface;

a body member rigidly connected to said platform means and extending upwardly therefrom, said body member comprising a saddle shaped seat positioned in spaced relation above said first horizontal circular surface of said platform means, said saddle shaped seat having a forward end, a rearward end, and opposite lateral sides, and handle means positioned above and forwardly of said saddle shaped seat;

said first circular horizontal surface of said platform having an outer circumferential edge which is sufficiently large to protrude laterally beyond said lateral sides of said saddle shaped seat and to protrude forwardly and rearwardly beyond said forward and rearward ends of said saddle shaped seat so as to form first and second foot rests positioned below and on opposite sides of said saddle shaped seat whereby a child sitting astride said saddle shaped seat can rest its feet on said first and second foot rests, said circular shape of said circular horizontal surface permitting said child to move its feet forwardly and rearwardly while resting on said first and second foot rests;

said platform means further comprising a second flat horizontal surface having a circular outer perimeter spaced below, concentric with, and spaced radially outwardly from said outer perimeter of said first circular horizontal surface, a circular vertical wall extending downwardly, from said first horizontal surface to said second horizontal surface whereby said first horizontal surface, said circular vertical wall, and said second horizontal surface form a top hat shaped configuration.

2. A barber chair according to claim 1 comprising post means rigidly connecting said body member to said platform means.

3. A barber chair according to claim 2 wherein said body member includes a vertical centerline which is positioned in approximate registered alignment with the center of said first circular horizontal surface of said platform.

* * * * *